US009627856B2

(12) United States Patent
Stamper et al.

(10) Patent No.: US 9,627,856 B2
(45) Date of Patent: Apr. 18, 2017

(54) ELECTRODE BEAM WELDED SPARK PLUGS FOR INDUSTRIAL ELECTRODES

(71) Applicant: FEDERAL-MOGUL IGNITION COMPANY, Southfield, MI (US)

(72) Inventors: Andrew Stamper, Rochester, MI (US); Gordon McIntosh, Bay City, MI (US); Raymond Bayer, Bay City, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 14/709,004

(22) Filed: May 11, 2015

(65) Prior Publication Data

US 2015/0325983 A1 Nov. 12, 2015

Related U.S. Application Data

(62) Division of application No. 13/324,054, filed on Dec. 13, 2011, now Pat. No. 9,028,289.

(51) Int. Cl.

| | |
|---|---|
| ***H01T 13/39*** | (2006.01) |
| ***H01T 13/32*** | (2006.01) |
| ***H01T 21/02*** | (2006.01) |

(52) U.S. Cl.

CPC ..... *H01T 13/39* (2013.01); *H01T 13/32* (2013.01); *H01T 21/02* (2013.01)

(58) Field of Classification Search

CPC ..... H01T 13/39; H01T 21/02

See application file for complete search history.

(56) References Cited

U.S. PATENT DOCUMENTS

2006/0082276 A1* 4/2006 Havard ..... H01T 13/32 313/141

2011/0148276 A1* 6/2011 Sakayanagi ..... H01T 13/39 313/141

* cited by examiner

*Primary Examiner* — Andrew Coughlin

(74) *Attorney, Agent, or Firm* — Robert L Stearns; Dickinson Wright, PLLC

(57) ABSTRACT

An industrial spark plug (20) includes a central electrode (24) with a central base (30) formed of a nickel-based material and a central firing tip (32) formed of an iridium-based material. The central firing tip (32) has a tip thickness ($t_{ct}$) of 0.02 to 0.03 inches, a tip diameter ($d_{ct}$) of 0.1184 to 0.1776 inches, and an aspect ratio of 4.736 to 7.104. The central firing tip (32) is electron beam welded to the central base (30) to provide a robust joint therebetween. The central electron beam weld (36) includes a mixture of re-crystallized iridium-based material and re-crystallized nickel-based material extending continuously along and over the entire welding interface. The spark plug (20) also includes a ground electrode (26) with a ground firing tip (38) electron beam welded to a ground base (42).

21 Claims, 4 Drawing Sheets

FIG. 2
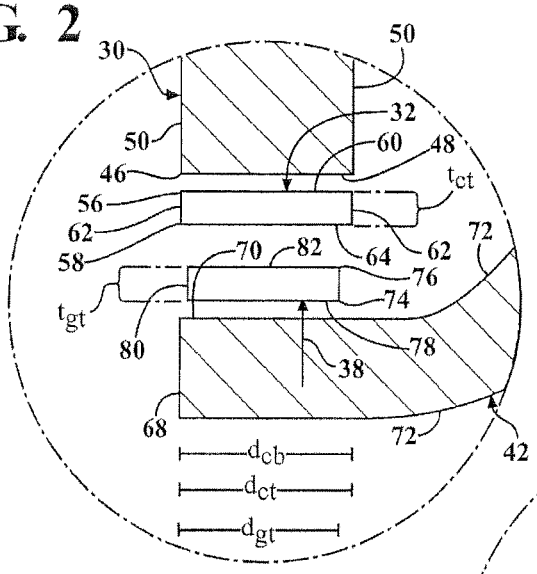
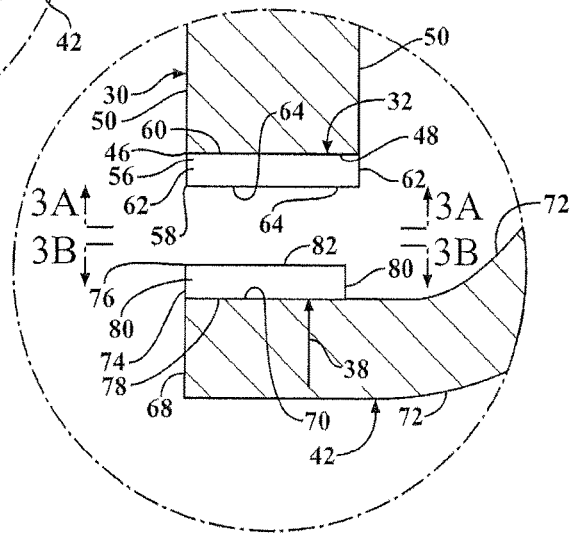
FIG. 3
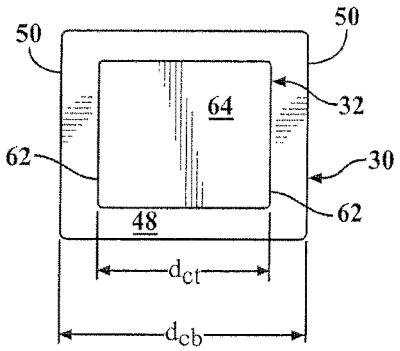
FIG. 3A
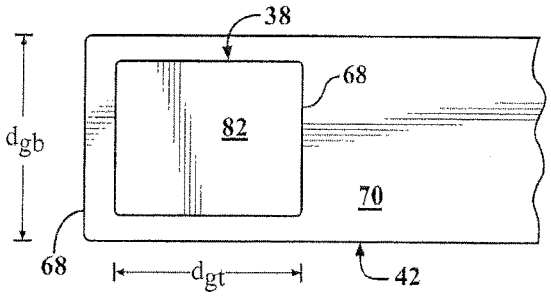
FIG. 3B

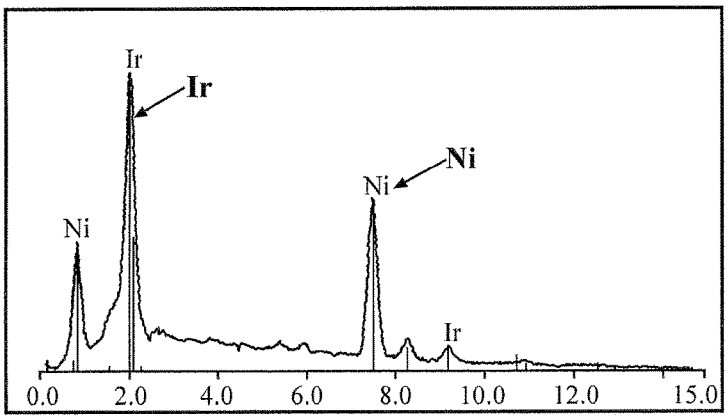
FIG. 7A
FIG. 7B
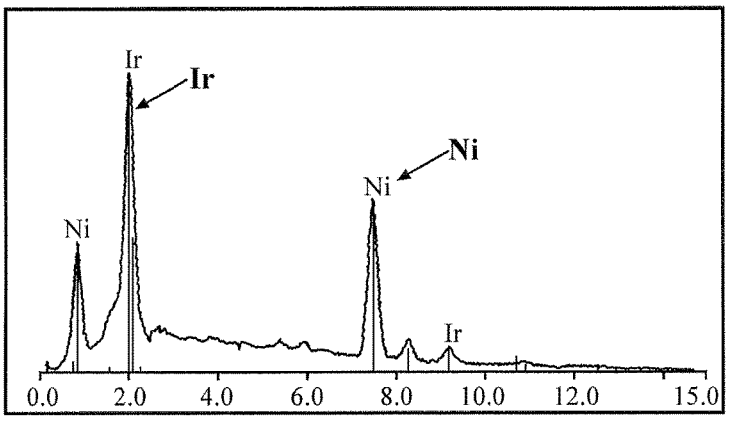
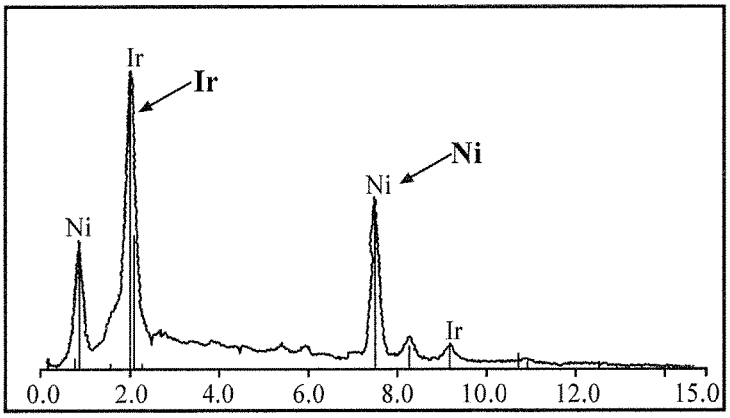
FIG. 7C

ELECTRODE BEAM WELDED SPARK PLUGS FOR INDUSTRIAL ELECTRODES

This divisional application claims priority to U.S. application Ser. No. 13/324,054, filed Dec. 13, 2011, and is incorporated herein by reference.

BACKGROUND OF THE INVENTION

1. Field of the Invention

This invention relates generally to spark plugs for internal combustion engines, and more particularly to electrode firing tips of the spark plugs and methods of forming the same.

2. Description of the Prior Art

Spark plugs of internal combustion engines for automotive and industrial applications typically include a central electrode and a ground electrode providing a spark gap therebetween. The electrodes provide a spark to ignite a mixture of fuel and air in a combustion chamber of an internal combustion engine. The electrodes, especially the firing ends along the spark gap, are exposed to high temperatures and extreme conditions in the combustion chamber. Thus, the electrodes are oftentimes designed to include a firing tip formed of precious metal material welded to a based formed of a nickel material. An example of this type of electrode is disclosed in U.S. Pat. No. 7,948,159 to Lykowski. The firing tip dissipates heat away from the firing end and prolongs the potential useful life of the spark plug.

SUMMARY OF THE INVENTION

One aspect of the invention includes a spark plug for providing a spark to ignite a combustible mixture in a combustion chamber. The spark plug includes a central electrode including a central base extending longitudinally from a terminal end to a central base end. A ground electrode including a ground base extends from a shell end to a ground base end. The central electrode and the ground electrode presenting a spark gap therebetween. At least one of the electrodes includes a firing tip having a tip end disposed adjacent the base end. The firing tip includes opposite tip sides extending continuously from the tip end to a firing end providing the spark gap. The firing tip has an aspect ratio of 4.0 to 8.0. The electrode includes an electron beam weld between the electrode base and the tip end of the firing tip. The electron beam weld extends continuously between the opposite tip sides of the firing tip.

Another aspect of the invention provides the electrode for use in a spark plug. The electrode includes the base extending to the base end and the firing tip having the tip end disposed adjacent the base end. The firing tip includes the opposite tip sides extending continuously from the tip end to the firing end. The firing tip has an aspect ratio of 4.0 to 8.0. The electrode also includes the electron beam weld between the electrode base and the tip end of the firing tip and extending continuously between the opposite tip sides.

Another aspect of the invention provides a method of forming a spark plug. The method includes providing the electrode base extending to the base end and providing the firing tip having opposite tip sides extending continuously from the tip end to the firing end and an aspect ratio of 4.0 to 8.0. The method next includes electron beam welding the electrode base and the firing tip together adjacent the base end and the tip end continuously between the opposite tip sides.

The materials of the base and firing tip, and the aspect ratio of the firing tip, allow the electron beam weld to extend continuously between the opposite tip sides of the firing tip, rather than extend only partially between the opposite tip sides, like many welded firing tips of the prior art. Thus, a stronger connection between the firing tip and the base of the electrode is provided, compared to the prior art. Less joint distortion during manufacturing and less cracking during use of the electrode is also provided. Accordingly, the electrode provided by the subject invention prolongs the useful life of the electrode and the spark plug.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a cross-sectional view of the firing tips and electrode bases of FIG. 1 before the electron beam welding step;

FIG. 3 is a cross-sectional view of the firing tips disposed on the electrode bases of FIG. 2 before the electron beam welding step;

FIG. 3A is a view of the central firing surface of FIG. 3 along line A;

FIG. 3B is a view of the ground firing surface of FIG. 3 along line B;

FIG. 7A includes spectra illustrating the composition of the electron beam weld at a first section along the electron beam weld;

FIG. 7B includes spectra illustrating the composition of the electron beam weld at a second section along the electron beam weld different from the first section; and FIG. 7C includes spectra illustrating the composition of the electron beam weld at a third section along the electron beam weld different from the first and second section.

DETAILED DESCRIPTION

Figure 1:
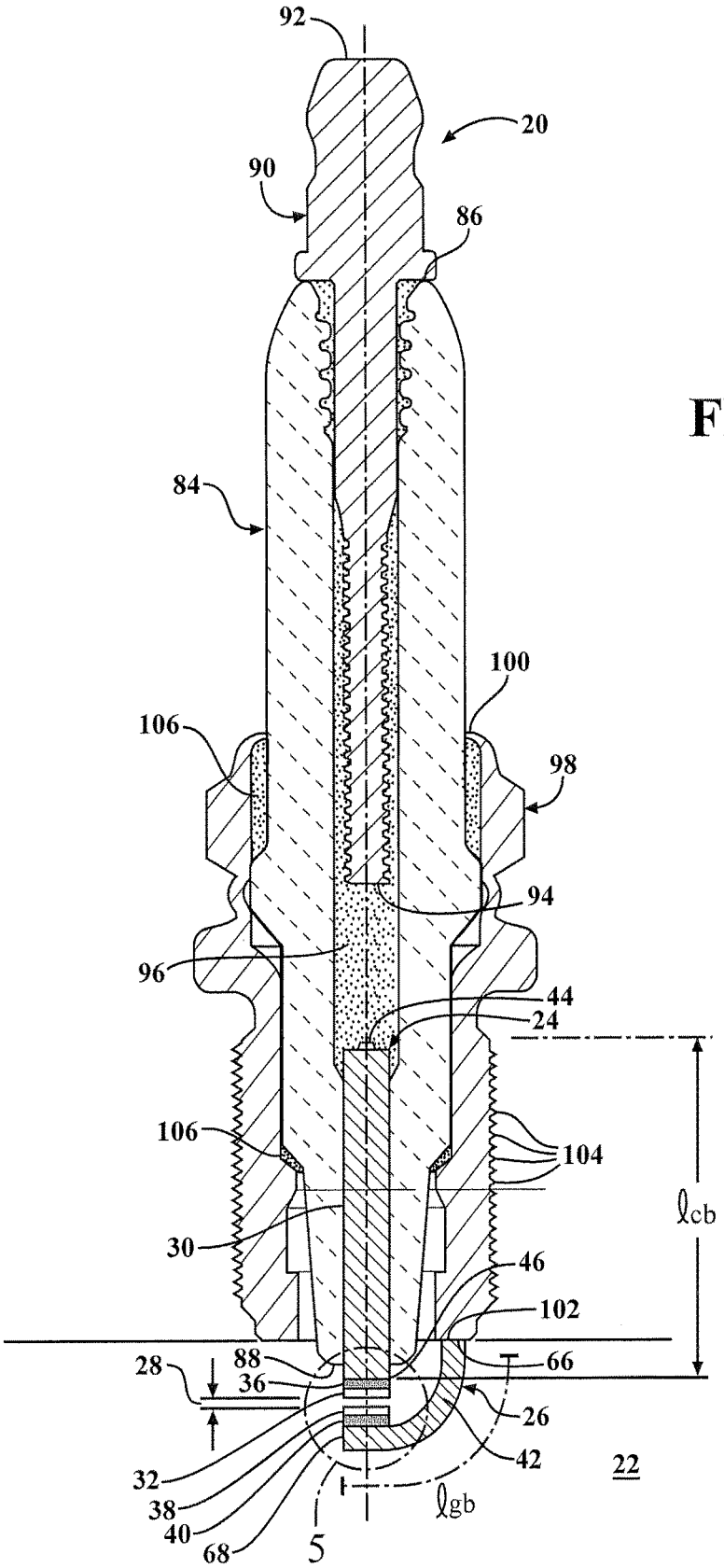
FIG. 1 is a cross sectional view of a spark plug including a central electrode with a central firing tip electron beam welded to a central base and a ground electrode with a ground firing tip electron beam welded to a ground base according to one embodiment of the subject invention.

One aspect of the invention includes a spark plug 20 for providing a spark to ignite a combustible mixture of fuel and air in a combustion chamber 22 of an internal combustion engine, as shown in FIG. 1. The spark plug 20 includes a central electrode 24 and a ground electrode 26 presenting a spark gap 28 therebetween. The central electrode 24 includes a central base 30 formed of a nickel-based material and a central firing tip 32 formed of an iridium-based material and having an aspect ratio of 5.736 to 7.104. The central base 30 and central firing tip 32 are welded together using an electron beam 34 to provide a strong hermetic seal therebetween. The central electron beam weld 36 extends continuously across the entire welding interface between the central base 30 and the central firing tip 32. Thus, the invention provides a stronger lock between the central base 30 and the central firing tip 32, compared to welded electrode joints of the prior art. The ground electrode 26 can also include a ground firing tip 38 with a ground electron beam weld 40 between the ground firing tip 38 and the ground base 42.

As shown in FIG. 1, the central electrode 24 of the spark plug 20 includes the central base 30 extending longitudinally from a terminal end 44 to a central base end 46. The central base 30 has a central base length $l_{cb}$ extending longitudinally from the terminal end 44 to the central base end 46. In one embodiment, the central base length $l_{cb}$ is 0.75 to 1.25 inches.

As shown in FIGS. 2 and 3, the central base 30 also presents a central base welding surface 48 extending between opposite central base sides 50 at the central base end 46, which is at least partially exposed to the combustion chamber 22. The central base welding surface 48 has a central base diameter $d_{cb}$ extending between the opposite central base sides 50. In one embodiment, the central base diameter $d_{cb}$ is 0.01 to 0.02 inches, or 0.119685 to 0.179527 inches, and preferably 0.149606 inches. The central base welding surface 48 also presents a surface area. In one embodiment, the surface area of the central base welding surface 48 is at least 0.0113 square inches. The diameter, length, thickness, and surface area measurements are determined before electron beam welding the central firing tip 32 to the central base 30.

The central base 30 is formed of a nickel-based material, which extends from the terminal end 44 to the central base end 46. The nickel-based material includes nickel in an amount at least 60.0 wt. %, or at least 70.0 wt. %, or at least 80.0 wt. %, or at least 90.0 wt. %, based on the total weight of the nickel-based material, and preferably a balance of nickel. In one embodiment, the nickel-based material includes nickel in an amount of at least 72.0 wt. %, chromium in an amount of 14.0 to 16.0 wt. %, and iron in an amount of 6.0 to 10.0 wt. %, based on the total weight of the nickel-based material. In one preferred embodiment, the nickel-based material is Inconel® 600. In an alternate embodiment, the central base 30 includes a clad of the nickel-based material surrounding a core of a copper-based material.

The central firing tip 32 of the central electrode 24 has a central tip end 56 disposed on the central base end 46 and extends longitudinally to a central firing end 58. The central firing tip 32 also has a central tip thickness $t_{ct}$ extending from the central tip end 56 to the central firing end 58, as shown in FIG. 2. The central tip thickness $t_{ct}$ is significantly less than the central base length $l_{cb}$. In one embodiment, the central tip thickness $t_{ct}$ is 0.01 to 0.04 inches, or 0.02 to 0.03 inches, preferably 0.025 inches.

The central firing tip 32 presents a central tip welding surface 60 extending between opposite central tip sides 62 at the central tip end 56. The central tip welding surface 60 extends along the central base welding surface 48 to provide a welding interface therebetween. The central tip welding surface 60 has a central tip diameter $d_{ct}$ between the opposite central tip sides 62. The central tip diameter $d_{ct}$ is typically less than the central base diameter $d_{cb}$, but may be equal to the central base diameter $d_{cb}$. In one embodiment, the central tip diameter $d_{ct}$ is 0.1 to 0.2 inches, or 0.1184 to 0.1776 inches, preferably 0.148 inches. The central tip welding surface 60 presents a surface area. In one embodiment, the surface area of the central tip welding surface 60 is 0.0113 to 0.018 square inches.

The central firing tip 32 has central aspect ratio, which is equal to the central tip diameter $d_{ct}$ divided by the central tip thickness $t_{ct}$. In one embodiment, the aspect ratio is 4.0 to 8.0, or 4.736 to 7.104, and preferably 5.92. The central tip diameter $d_{ct}$ and the central tip thickness $t_{ct}$ are determined before electron beam welding the central firing tip 32 to the central base 30.

The central firing tip 32 also presents a central firing surface 64 opposite the central tip welding surface 60 at the central firing end 58, as shown in FIGS. 2, 3, and 3A. The central firing surface 64 also has the central tip diameter $d_{ct}$ extending between the opposite central tip sides 62. The central firing surface 64 has a surface area exposed to the combustion chamber 22 and presenting the spark gap 28. The surface area of the central firing surface 64 is typically equal to the surface area of central tip welding surface 60. In one embodiment the surface area of the central firing surface 64 is 0.0113 to 0.018 square inches.

The central firing tip 32 includes the iridium-based material, which extends continuously from the central tip end 56 to the central firing end 58. The iridium-based material includes iridium in an amount of at least 70.0 wt. %, or at least 80.0 wt. %, or at least 90.0 wt. %, or at least 95.0 wt. %, based on the total weight of the iridium-based material, and preferably a balance of iridium. The iridium-based material also includes rhodium in an amount of 1.0 to 3.0 wt. %, preferably 2.0 wt. %; tungsten in an amount of 0.1 to 0.5 wt. %, preferably 0.3 wt. %; and zirconium in an amount of 0.01 to 0.03 wt. %, preferably 0.02 wt. %, based on the total weight of the iridium-based material. In an alternate embodiment, the central firing tip 32 includes another precious metal material, such as a titanium, silver, gold, or platinum material.

Figure 4:
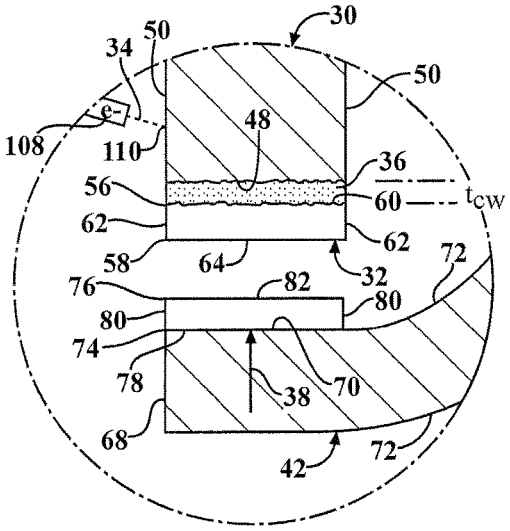
FIG. 4 is a cross-sectional view of the firing tips of FIG. 3 and an electron beam gun welding the central firing tip to the central base.
Figure 5:
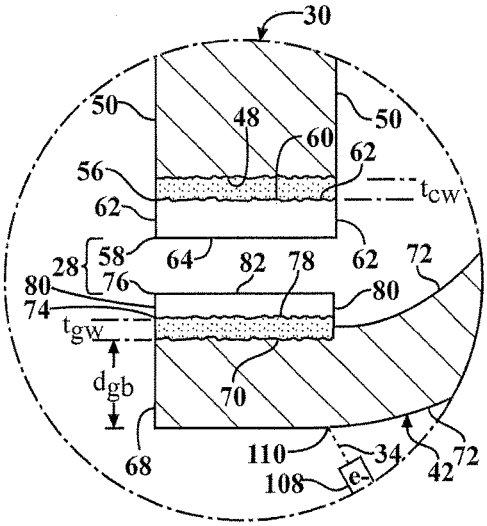
FIG. 5 is a cross-sectional view of the firing tips of FIG. 4 and an electron beam gun welding the ground firing tip to the ground base.

The central tip welding surface 60 of the central firing tip 32 is disposed on the central base welding surface 48 of the central base 30 to provide a welding interface therebetween. The central firing tip 32 is then electron beam welded to the central base 30 to provide the central electron beam weld 36 extending continuously between the opposite central tip sides 62, as shown in FIGS. 1, 4, and 5.

The central tip welding surface 60 and the central base welding surface 48 are modified during the electron beam welding process. Prior to the electron beam welding step, the central tip welding surface 60 and the central base welding surface 48 are planar, as shown in FIGS. 2 and 3. During the electron beam welding step, the central tip welding surface 60 recedes toward the central firing end 58, and the central base welding surface 48 recedes away from the central firing tip 32. The central welding surfaces 60, 48 of the finished spark plug 20 are non-planar, as shown in FIGS. 1, 4, and 5. The central electron beam weld 36 extends continuously and entirely over the modified central base welding surface 48 and the modified central tip welding surface 60. Thus, a hermetic seal is provided between central base 30 and the central firing tip 32. The central electron beam weld 36 also has a weld thickness $t_{cw}$ being generally uniform along the central welding surfaces 48, 60 between the opposite central tip sides 62, as shown in FIG. 4. In one embodiment, the central electron beam weld 36 also has a weld thickness $t_{cw}$ of 0.015 to 0.035 inches.

The central electron beam weld 36 includes a mixture of the iridium-based material and the nickel-based material. In one embodiment, the central electron beam weld 36 includes the iridium-based material in an amount of at least 30.0 wt.

Figure 6:
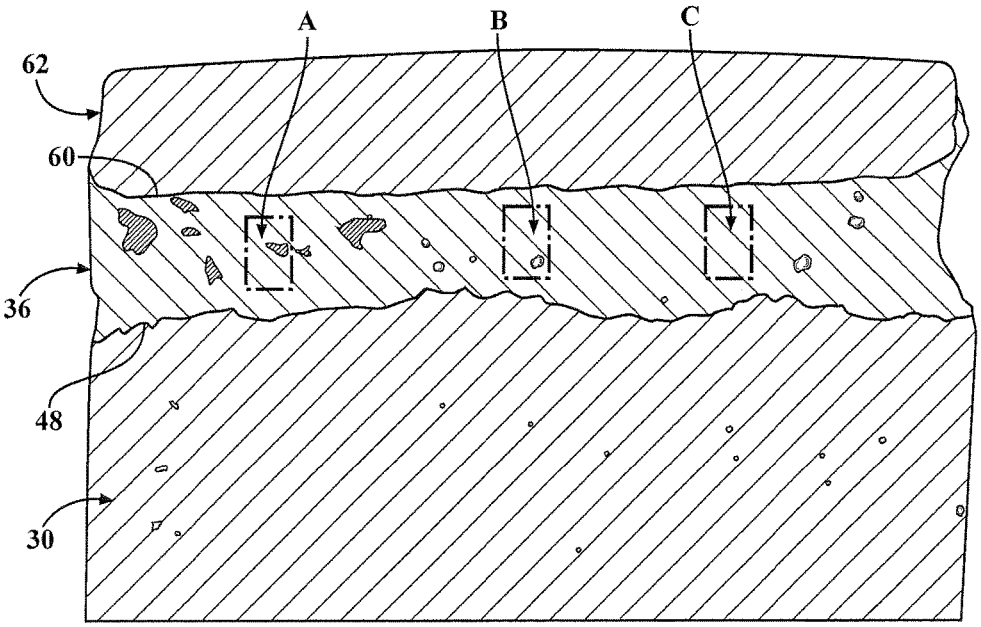
FIG. 6 is a photomicrograph of a firing tip electron beam welded to a base of an electrode according to one embodiment of the invention.

% and the nickel-based material in an amount of at least 30.0 wt. %, based on the total weight of the central electron beam weld 36. The portion of the iridium-based material extending along the central tip welding surface 60 and the portion of the nickel-based material extending along the central base welding surface 48 are completely melted during the electron beam welding process and then re-crystallized to provide the central electron beam weld 36. This mixture of the re-crystallized iridium-based material and the re-crystallized nickel-based material of the extends continuously between the opposite central tip sides 62 and also extends continuously along and entirely over the central base welding surface 48 and the central tip welding surface 60. Thus, the central electron beam weld 36 provides a strong lock between the central base 30 and the central firing tip 32. FIG. 6 is a photomicrograph of the central electron beam weld 36 and FIG. 7 is a spectra showing the composition of the central electron beam weld 36 includes the mixture extending continuously between the opposite central tip sides 62. The central electron beam weld 36 can provide 100% penetration across the welding interface and the central electrode 24 is typically free of cracks.

Either the ground electrode 26 or the central electrode 24 can include the electron beam weld 36, 40, and preferably both include the electron beam weld 36, 40.

The ground electrode 26 of the spark plug 20 includes the ground base 42 extending and curving from a shell end 66 to a ground base end 68. The ground base 42 includes ground base sides 72 each having a ground base length $l_{gb}$ extending and curving from the shell end 66 to the ground base end 68. In one embodiment, the ground base length $l_{gb}$ is 0.75 to 1.25 inches. The diameter, length, thickness, and surface area measurements discussed herein are determined before electron beam welding the ground firing tip 38 to the ground base 42.

As shown in FIGS. 2, 3, and 3A, the ground base 42 also presents a ground base welding surface 70 along one of the ground base sides 72 facing the central firing tip 56 and adjacent the ground base end 68. The ground base welding surface 70 also presents a surface area. The ground base welding surface 70 has a ground base diameter $d_{gb}$ extending along the ground base end 68. In one embodiment, the ground base diameter $d_{gb}$ is 0.01 to 0.02 inches, or 0.119685 to 0.179527 inches, and preferably 0.149606 inches.

The ground base 42 is typically formed of the same nickel-based material used to form the central base 30. The nickel-based material includes nickel in an amount at least 60.0 wt. %, or at least 70.0 wt. %, or at least 80.0 wt. %, or at least 90.0 wt. %, based on the total weight of the nickel-based material, and preferably a balance of nickel. In one embodiment, the nickel-based material includes nickel in an amount of at least 72.0 wt. %, chromium in an amount of 14.0 to 16.0 wt. %, and iron in an amount of 6.0 to 10.0 wt. %, based on the total weight of the nickel-based material. In one preferred embodiment, the nickel-based material is Inconel® 600. In an alternate embodiment, the ground base 42 includes a clad of the nickel-based material surrounding a core of a copper-based material.

The ground firing tip 38 of the ground electrode 26 includes a ground tip end 74 initially disposed on the ground base welding surface 70 of the ground base 42. The ground firing tip 74 extends longitudinally to a ground firing end 76. The ground firing tip 38 is disposed adjacent the ground base end 68 and faces the central firing tip 32. The ground firing tip 38 has a ground tip thickness $t_{gt}$ extending from the ground tip end 74 to the ground firing end 76. In one embodiment, the ground tip thickness $t_{gt}$ is 0.01 to 0.04 inches, or 0.02 to 0.03 inches, and preferably 0.025 inches.

The ground firing tip 38 presents a ground tip welding surface 78 extending between opposite ground tip sides 80 at the ground tip end 74. Prior to the electron beam welding step, the ground tip welding surface 78 extends along the ground base welding surface 70 to provide a welding interface therebetween, as shown in FIGS. 3 and 4. The ground tip welding surface 78 has a ground tip diameter $d_{gt}$ between the opposite ground tip sides 80. The ground tip diameter $d_{gt}$ is less than the ground base diameter $d_{gb}$. In one embodiment, the ground tip diameter $d_{gt}$ is 0.1 to 0.2 inches, or 0.1184 to 0.1776 inches, and preferably 0.148 inches. The ground tip welding surface 78 presents a surface area. In one embodiment, the surface area of the ground tip welding surface 78 is 0.0113 to 0.018 square inches.

The ground firing tip 38 has an aspect ratio, which is equal to the ground tip diameter $d_{gt}$ divided by the ground tip thickness $t_{gt}$. In one embodiment, the aspect ratio is 4.0 to 8.0, or 4.736 to 7.104, and preferably 5.92. The aspect ratio of the ground firing tip 38 is typically equal to the aspect ratio of the central firing tip 32, but may be different. The ground tip diameter $d_{gt}$ and the ground tip thickness $t_{gt}$ are determined before electron beam welding the ground base 42 to the ground firing tip 38.

The ground firing tip 38 also presents a ground firing surface 82 opposite the ground tip welding surface 78 at the ground firing end 76. The ground firing surface 82 is exposed to the combustion chamber 22 at the spark gap 28. The ground firing surface 82 also has the ground tip diameter $d_{gt}$ extending between the opposite ground tip sides 80. The surface area of the ground firing surface 82 is typically equal to the surface area of ground tip welding surface 78.

The ground firing tip 38 preferably includes the iridium-based material used to form the central firing tip 32. The iridium-based material includes iridium in an amount of at least 70.0 wt. %, or at least 80.0 wt. %, or at least 90.0 wt. %, or at least 95.0 wt. %, based on the total weight of the iridium-based material, and preferably a balance of iridium. The iridium-based material also includes rhodium in an amount of 1.0 to 3.0 wt. %, preferably 2.0 wt. %; tungsten in an amount of 0.1 to 0.5 wt. %, preferably 0.3 wt. %; and zirconium in an amount of 0.01 to 0.03 wt. %, preferably 0.02 wt. %, based on the total weight of the iridium-based material. In an alternate embodiment, the ground firing tip 38 includes another precious metal material, such as a titanium, silver, gold, or platinum material.

During the method of forming the spark plug, the ground tip welding surface 78 of the ground firing tip 38 is disposed on the ground base welding surface 70 of the ground base 42 to provide a welding interface therebetween. The ground firing tip 38 is then electron beam welded to the ground base 42 such that a ground electron beam weld 40 extends continuously between the opposite ground tip sides 80, as shown in FIGS. 1 and 5. The ground tip welding surface 78 and the ground base welding surface 70 are modified during the electron beam welding process. Prior to the electron beam welding step, the ground tip welding surface 78 and the ground base welding surface 70 are generally planar, as shown in FIGS. 2 and 3. During the electron beam welding step, the ground tip welding surface 78 recedes toward the ground firing end 76, and the ground base welding surface 70 recedes away from ground firing tip 38. The ground welding surfaces 70, 78 of the finished spark plug 20 are non-planar, as shown in FIGS. 1 and 5. The ground electron beam weld 40 extends continuously and entirely over the modified ground base welding surface 70 and the modified ground tip welding surface 78. Thus, a hermetic seal is provided between ground base 42 and the ground firing tip 38. The ground electron beam weld 40 also has a weld thickness $t_{gw}$ being generally uniform along the welding surfaces 70, 78 between the opposite ground tip sides 80. In one embodiment, the ground electron beam weld 40 also has a weld thickness $t_{gw}$ of 0.015 to 0.035 inches.

The ground electron beam weld 40 includes a mixture of the iridium-based material and the nickel-based material. In one embodiment, the ground electron beam weld 40 includes the iridium-based material in an amount of at least 30.0 wt. % and the nickel-based material in an amount of at least 30.0 wt. %, based on the total weight of the ground electron beam weld 40. The portion of the iridium-based material along the ground tip welding surface 78 and the portion of the nickel-based material along the ground base welding surface 70 are completely melted during the electron beam welding process and then re-crystallized to provide the ground electron beam weld 40. This mixture of the re-crystallized iridium-based material and the re-crystallized nickel-based material extends continuously between the opposite ground tip sides 80 and also extends continuously along and entirely over the ground base welding surface 70 and the ground tip welding surface 78.

The firing tips 32, 38 of the electrodes 24, 26 can comprise a variety of shapes. The firing tips 32, 38 of FIGS. 1-5 have a generally rectangular cross section. In another embodiment, the firing tips 32, 38 have a round, or other shape.

The electrodes 24, 26 are used in spark plugs 20, particularly industrial spark plugs 20. The spark plugs 20 typically include an insulator 84 disposed annularly around the central electrode 24. The insulator 84 extends longitudinally from an insulator upper end 86 along the central base 30 toward the central firing end 58 to an insulator firing end 88. A portion of the central base 30 adjacent the central firing end 58 projects outwardly of the insulator firing end 88. The insulator 84 is formed of an electrically insulating material, such as alumina.

The spark plug 20 also includes a terminal 90 formed of an electrically conductive material received in the insulator 84 and extending from a first terminal end 92 to a second terminal end 94. The first terminal end 92 is electrically connected to a power source (not shown) and the second terminal end 94 is electrically connected to the terminal end 44 of the central base 30 to provide energy to the central electrode 24. A resistor layer 96 is disposed between and electrically connects the second terminal end 94 of the terminal 90 and the terminal end 44 of the central base 30 for transmitting energy from the terminal 90 to the central electrode 24. The resistor layer 96 is formed of an electrically resistive material, such as a glass seal.

A shell 98 is disposed annularly around and longitudinal along the insulator 84 from an upper shell end 100 to a lower shell end 102. A portion of the insulator 84 adjacent the insulator firing end 88 projects outwardly of the lower shell end 102. As shown in FIG. 1, the shell end 66 of the ground electrode 26 is attached to the lower shell end 102. In one embodiment, the shell 98 includes a connection means, such as a plurality of threads 104, for engaging a cylinder head of the internal combustion engine. The shell 98 is formed of a metal material, such as steel. In one embodiment, a packing element 106, such a gasket, cement, or other sealing compound, is disposed between the insulator 84 and the shell 98 for providing a gas-tight seal therebetween. The packing element 106 may also be disposed between the insulator 84 and the terminal 90.

Another aspect of the invention provides a method of forming the spark plug 20. The method includes providing either the central electrode 24 or the ground electrode 26, or both, with the electron beam weld 36, 40 between the base 30, 42 and the firing tip 32, 38. In one embodiment, the method first includes providing the central base 30 extending from a terminal end 44 to the central base end 46. The central base 30 provided is preferably formed of the nickel-based material and presents the central base welding surface 48 extending between opposite central base sides 50 at the central base end 46. The central base welding surface 48 has the central base diameter $d_{cb}$ extending between the opposite central base sides 50. In one embodiment, the central base diameter $d_{cb}$ provided is 0.1 to 0.2 inches, or 0.119685 to 0.179527 inches, and preferably 0.149606 inches.

The method also includes providing the central firing tip 32 extending longitudinally from the central tip end 56 to the central firing end 58. The central firing tip 32 is provided to have the central tip thickness $t_{ct}$ extending from the central tip end 56 to the central firing end 58. In one embodiment, the central tip thickness $t_{ct}$ is provided as 0.01 to 0.04 inches, or 0.02 to 0.03 inches, preferably 0.025 inches. The central firing tip 32 presents the central tip welding surface 60 extending between the opposite central tip sides 62 at the central tip end 56. The central tip welding surface 60 has the central tip diameter $d_{ct}$ between the opposite central tip sides 62. In one embodiment, the central tip diameter $d_{ct}$ is provided as 0.1 to 0.2 inches, or 0.1184 to 0.1776 inches, and preferably 0.148 inches. The method can alternatively or additionally include providing the ground base 42 and ground firing tip 38, as shown in FIG. 2.

After providing the central base 30 and the central firing tip 32, the method includes disposing the central base 30 and the central firing tip 32 in a vacuum chamber. The vacuum chamber has a pressure $1\times10^{-3}$ torr to $1\times10^{-5}$ torr and a temperature of 60 to 100° F. The vacuum chamber environment provides the advantage of very low levels of impurities. Next, the method includes disposing the central tip welding surface 60 along the central base welding surface 48 to provide the welding interface therebetween. The method can alternatively or additionally include disposing the ground tip welding surface 78 along the ground base welding surface 70 to provide the welding interface therebetween, as shown in FIG. 3.

The method next includes electron beam welding the central base 30 and the central firing tip 32 together along the welding interface, as shown in FIG. 4. In one embodiment, the electron beam welding step includes disposing an electron beam gun 108 adjacent the central base 30, such that the electron beam gun 108 is directed at a focal point 110, which is along the central base 30 but spaced from the welding interface. The electron beam welding step further includes applying the beam 34 of electrons to the focal point 110 on the central base 30 at an energy of 0.21 to 0.31 kJ/inch. In one embodiment, the beam 34 of electrons has a width of 0.008 to 0.012 inches, and is applied to the central base 30 for a time period of 1.5 to 2.1 seconds. The energy, width, and timing of the electron beam 34 is adjusted using a magnetic field. The use of a magnetic field provides excellent weld control and less joint distortion from the induced energy, especially when welding thin firing tips 32, 38 having the aspect ratio of 4.0 to 8.0.

The electrons emitted from the electron beam weld melt the iridium-based material at and adjacent the central tip welding surface 60 and melt the nickel-based material at and along the central base welding surface 48. As shown in FIG. 4, the central tip welding surface 60 and the central base welding surface 48 are modified due to the melting of the iridium-based material and the nickel-based material during the electron beam welding step, and the central electron beam weld 36 is formed between the modified central welding surfaces 48, 60. Prior to the electron beam welding step, the central tip welding surface 60 and the central base welding surface 48 are generally planar, as shown in FIG. 2. During the electron beam welding step, the central tip welding surface 60 recedes toward the central firing end 58, and the central base welding surface 48 recedes away from the central firing tip 32, as shown in FIG. 4.

The melted iridium-based material and the melted nickel-based material then re-crystallize to provide the central electron beam weld 36. The central electron beam weld 36 includes a mixture of the iridium-based material and the nickel-based material. In one embodiment, the central electron beam weld 36 includes the iridium-based material in an amount of at least 30.0 wt. % and the nickel-based material in an amount of at least 30.0 wt. %, based on the total weight of the central electron beam weld 36. The re-crystallized iridium-based material extends continuously between the opposite central tip sides 62 and also extends continuously along and entirely over the central base welding surface 48 and the central tip welding surface 60. The re-crystallized nickel-based material also extends continuously between the opposite central tip sides 62 and also extends continuously along and entirely over the central base welding surface 48 and the central tip welding surface 60.

The method preferably includes electron beam welding the ground base 42 and the ground firing tip 38 to one another, as shown in FIG. 5. In one preferred embodiment, both the central electrode 24 and the ground electrode 26 include the electron beam weld 36, 40. In another embodiment, only one of the electrodes 24, 26 includes the electron beam weld 36, 40.

The use of electron beam welding allows for high energy capability per unit area and a tight weld zone. The method also allows the dissimilar metals of the firing tip 32, 38 and the base 30, 42 to be welded at 100% penetration levels. Thus, the method provides a more robust lock between the firing tip 32, 38 and the base 30, 42 and thus less cracking and failure of the joint during operation of the spark plug 20.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. In addition, the reference numerals in the claims are merely for convenience and are not to be read in any way as limiting.

What is claimed is:

1. A spark plug for providing a spark to ignite a combustible mixture in a combustion chamber, comprising:

a central electrode including a central base extending longitudinally from a terminal end to a central base end, a ground electrode including a ground base extending from a shell end to a ground base end, said central electrode and said ground electrode presenting a spark gap therebetween, at least one of said electrodes including a firing tip having a tip end disposed adjacent said base end, said firing tip including opposite tip sides extending continuously from said tip end to a firing end providing said spark gap, said firing tip presenting a tip diameter extending between said opposite tip sides and a tip thickness extending from said tip end to said firing end, the spark plug being formed by a process comprising the steps of: providing said firing tip with an aspect ratio of 4.736 to 8.0 and electron beam welding said firing tip to said electrode base, said electrode including an electron beam weld between said electrode base and said tip end of said firing tip, wherein said aspect ratio of said firing tip is determined by dividing said tip diameter before welding said firing tip to said electrode base by said tip thickness before welding said firing tip to said electrode base, and said electron beam weld extending continuously between said opposite tip sides.

2. The spark plug of claim 1 wherein said firing tip presents a tip welding surface extending continuously between said opposite tip sides at said tip end and said electron beam weld extends continuously over said tip welding surface.

3. The spark plug of claim 1 wherein said firing tip includes an iridium-based material including iridium in an amount of at least 70.0 wt. %, based on the total weight of said iridium-based material.

4. The spark plug of claim 3 wherein said iridium-based material includes iridium in an amount of at least 95.0 wt. %, rhodium in an amount of 1.0 to 3.0 wt. %, tungsten in an amount of 0.1 to 0.5 wt. %, and zirconium in an amount of 0.01 to 0.03 wt. %, based on the total weight of said iridium-based material.

5. The spark plug of claim 1 wherein said electrode base includes a nickel-based material including nickel in an amount of at least 60.0 wt. %, based on the total weight of said nickel-based material.

6. The spark plug of claim 1 wherein said electrode base is formed of a nick-based material including nickel in an amount of at least 60.0 wt. %, based on the total weight of said nickel-based material, and said firing tip is formed of an iridium-based material, including iridium in an amount of at least 60.0 wt. %, based on the total weight of said iridium-based material, said electron beam weld includes a mixture of said nickel-based material and said iridium-based material, and said mixture extends continuously between said opposite tip sides.

7. The spark plug of claim 6 wherein said nickel-based material and said iridium-based material of said electron beam weld is re-crystallized.

8. The spark plug of claim 7 wherein said electron beam weld includes said re-crystallized nickel-based material and said re-crystallized iridium-based material each in an amount of at least 30% wt. %, based on the total weight of said electron beam weld.

9. The spark plug of claim 1 wherein said tip thickness is 0.02 to 0.03 inches.

10. The spark plug of claim 1 wherein said tip diameter is 0.1184 to 0.1776 inches.

11. The spark plug of claim 1 wherein said aspect ratio of said firing tip is 4.736 to 7.104.

12. A spark plug for providing a spark to ignite a combustible mixture of fuel and air of combustion chamber, comprising:

a central electrode including a central base extending longitudinally from a terminal end to a central base end, said central base being formed of a nickel-based material including nickel in an amount of at least 60.0 wt. %, based on the total weight of said nickel-based material, a ground electrode including a ground base extending from a shell end to a ground base end, said ground base being formed of a nickel-based material including nickel in an amount of at least 60.0 wt. %, based on the total weight of said nickel-based material, said central electrode and said ground electrode presenting a spark gap therebetween, at least one of said electrodes including a firing tip having a tip end disposed adjacent said base end, said firing tip including opposite tip sides extending longitudinally from said tip end to a firing end at said spark gap, said firing tip presenting a tip welding surface extending continuously between said opposite tip sides at said tip end, said firing tip having a tip thickness extending from said tip end to said firing end, wherein said tip thickness is 0.02 to 0.03 inches, said firing tip having a tip diameter extending between said opposite tip sides, wherein said tip diameter is 0.1184 to 0.1776 inches, the spark plug being formed by a process comprising the steps of: providing said firing tip with an aspect ratio of 4.736 to 7.104 and electron beam welding said firing tip to said electrode base, said firing tip being formed of an iridium-based material including iridium in an amount of at least 95.0 wt. %, %, rhodium in an amount of 1.0 to 3.0 wt. %, tungsten in an amount of 0.1 to 0.5 wt. %, and zirconium in an amount of 0.01 to 0.03 wt. %, based on the total weight of said iridium-based material, said electrode including an electron beam weld between said electrode base and said firing tip, wherein said aspect ratio of said firing tip is determined by dividing said tip diameter before welding said firing tip to said electrode base by said tip thickness before welding said firing tip to said electrode base, said electron beam weld extending continuously between said opposite tip sides and continuously over said tip welding surface, said electron beam weld including a mixture of said nickel-based material and said iridium-based material, said nickel-based material and said iridium-based material of said electron beam weld being re-crystallized, and said electron beam weld including said re-crystallized iridium-based material and said re-crystallized nickel-based material each in an amount of at least 30% wt. %, based on the total weight of said electron beam weld.

13. An electrode for use in a spark plug, comprising:

a base extending to a base end, said electrode including a firing tip having a tip end disposed adjacent said base end, said firing tip including opposite tip sides extending continuously from said tip end to a firing end, said firing tip presenting a tip diameter extending between said opposite tip sides and a tip thickness extending from said tip end to said firing end, the electrode being formed by a process comprising the steps of: providing said firing tip with an aspect ratio of 4.736 to 8.0 and electron beam welding said firing tip to said base, said electrode including an electron beam weld between said electrode base and said tip end of said firing tip, wherein said aspect ratio of said firing tip is determined by dividing said tip diameter before welding said firing tip to said electrode base by said tip thickness before welding said firing tip to said electrode base, and said electron beam weld extending continuously between said opposite tip sides.

14. The electrode of claim 13 wherein said firing tip presents a tip welding surface extending continuously between said opposite tip sides at said tip end and said electron beam weld extends continuously over said tip welding surface.

15. The electrode of claim 13 wherein said firing tip includes an iridium-based material including iridium in an amount of at least 70.0 wt. %, based on the total weight of said iridium-based material.

16. The electrode of claim 13 wherein said electrode base is formed of a nick-based material including nickel in an amount of at least 60.0 wt. %, based on the total weight of said nickel-based material, and said firing tip is formed of an iridium-based material, including iridium in an amount of at least 60.0 wt. %, based on the total weight of said iridium-based material, said electron beam weld includes a mixture of said nickel-based material and said iridium-based material, and said mixture extends continuously between said opposite tip sides.

17. The electrode of claim 16 wherein said nickel-based material and said iridium-based material of said electron beam weld is re-crystallized.

18. The electrode of claim 13 wherein said tip thickness is 0.02 to 0.03 inches.

19. The electrode of claim 13 wherein said tip diameter is 0.1184 to 0.1776 inches.

20. The electrode of claim 13 wherein said aspect ratio of said firing tip is 4.736 to 7.104.

21. A spark plug for providing a spark to ignite a combustible mixture in a combustion chamber, comprising:

a central electrode including a central base extending longitudinally from a terminal end to a central base end, a ground electrode including a ground base extending from a shell end to a ground base end, said central electrode and said ground electrode presenting a spark gap therebetween, at least one of said electrodes including a firing tip having a tip end disposed adjacent said base end, said firing tip including opposite tip sides extending continuously from said tip end to a firing end providing said spark gap, said electrode including an electron beam weld between said electrode base and said tip end of said firing tip, said electron beam weld extending continuously between said opposite tip sides, and said electron beam weld having a weld thickness of 0.015 to 0.035 inches.

* * * * *